United States Patent [19]

Drake

[11] 4,306,434

[45] Dec. 22, 1981

[54] KEY RETAINER OR THE LIKE

[76] Inventor: Cal V. Drake, P.O. Box 9217, Marina del Rey, Calif. 90291

[21] Appl. No.: 159,602

[22] Filed: Jun. 16, 1980

[51] Int. Cl.[3] ..... A47G 29/10

[52] U.S. Cl. ..... 70/458

[58] Field of Search ..... 70/456–459; 24/3 K, 230.5 R, 236, 237; 224/268, 269, 270, 267

[56] References Cited

U.S. PATENT DOCUMENTS 3,146,925 9/1964 Ruderia ..... 224/268

3,659,759 5/1972 Walton ..... 70/458

*Primary Examiner*—Robert L. Wolfe

*Attorney, Agent, or Firm*—Cislo, O'Reilly & Thomas

[57] ABSTRACT

A key retainer or the like of specific curvilinear configuration wherein a first upper portion is provided with a specific hook-like shape so as to permit ease of releasable and captive association with a belt loop, a belt, or pocket recess or trousers or the like, wherein keys may be satisfactorily contained on a lower portion of the retainer in a facile manner and in a manner that allows ease of access.

7 Claims, 3 Drawing Figures

KEY RETAINER OR THE LIKE

BACKGROUND OF THE INVENTION

In today's modern styles of trousers, many of which do not have pockets, the present fashions dictate smooth lines which presents difficulties with regard to the wearer of the fashions having means available for carrying indespensible needs such as keys or the like.

The herein disclosed invention provides for a Key Retainer Or The Like which does not require pockets for ease of accessibility. The key retainer of the present invention is configured in such a manner that it may not only retain keys in captive relationship therewith, but may be also captively and releasably retained on trousers not having pockets by a hook-like portion which is adapated to be associated with a belt loop or belt of trousers.

Where the trousers do have pockets or the like, the key Retainer Or The Like of the invention may be disposed at the terminal outside edge of the pocket in secure fashion and allow keys to be disposed outside the pocket as opposed to being contained within the pocket.

The Key Retainer Or The Like of the invention has a unique curvilinear configuration which is spherical, plane-segment-like, which follows the contour of the hip portion of the human body.

OBJECTS AND SUMMARY OF THE INVENTION

It is an object of the invention to provide a Key Retainer Or the Like having a unique configuration.

It is another object of the invention to provide a Key Retainer Or The Like having a body member with first and second portions wherein the key retainer is adapted to carry keys on a user of the key retainer in a facile manner.

It is another still further object of the invention to provide a key retainer having a curvilinear, in elevation view, configuration which follows the contour of a body portion of a human wearer thereof.

It is still another even further more specific object of the invention to provide a key retainer which is adapted to carry keys and which is adapted to be captively and releasably associated with belt or belt loop portions of trousers or the like.

It is another even further more specific object of the invention to provide a key retainer which is adapted to carry a number of keys in a relatively secure captive relationship on the body of the user without the need of having bulging pockets or the like.

It is another more even further specific object of the invention to provide a key retainer having an elongate body member with a hook-like upper portion adapted to be associated with a belt or belt loop of trousers and the like.

In one embodiment of the invention, a Key Retainer Or The Like comprises the combination of an elongate body member having a first portion adapted for releasable and captive retention of the key retainer, and, wherein a second portion is adapted to permit the captive retention of keys or the like thereon, and, wherein the elongate body member has a curvilinear configuration.

These and other objects of the invention will become apparent from the hereinafter following commentary taken in conjunction with the figures of drawing.

BRIEF DESCRIPTION OF THE DRAWING

FIG. 1 is a view of the Key Retainer Or The Like of the invention illustrating its retention on the belt loop of trousers or the like.

DESCRIPTION OF THE BEST EMBODIMENT CONTEMPLATED

Figure 1:
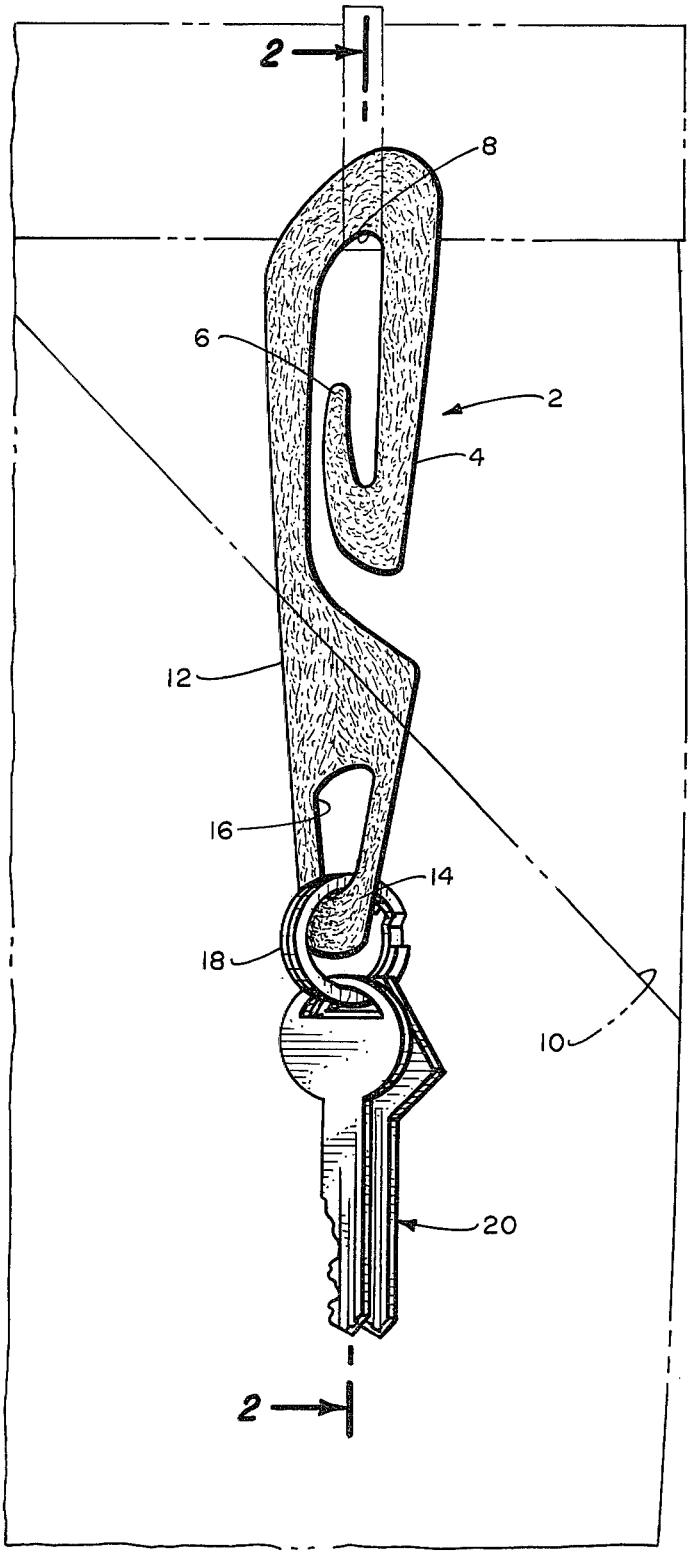

Referring to the figures of drawing, wherein like numerals of reference designate like elements throughout, it will be noted that the key retainer 2 of the invention has an elongate configuration having a first upper portion 4 of somewhat hook-like configuration terminating in up-turned portion 6 and forming inner edge 8 which may be positioned to be retained in captive, releasable fashion on the top edge of a belt or the like not shown.

Alternatively, the surface 8 may be disposed so as to be retained on the belt loop of trousers or the like. Alternatively, the surface 8 may be retained on the outside pocket edge 10 in which event, the key retainer 2 with retained keys may be positioned outside of the pocket to thereby obviate bulging pockets caused by the keys.

Integrally connected to upper portion 8 by means of mid-span 12 is lower or second portion 14 having an aperture 16 adapted to receive key ring 18 upon which may be disposed a plurality of keys 20.

The aperture 16 is shown as of irregular shape, but obviously an arcuate, circular or other such configuration would be suitable. The hook portion 6 of upper or first portion 4 may also be used to hook under a belt or the like to ensure better captive relationship of key retainer 2 with the clothing or the like of the user of key retainer 2.

Figure 2:
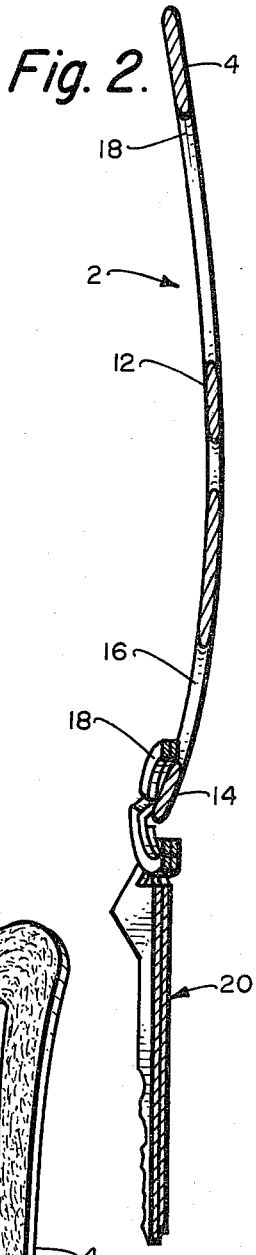
FIG. 2 is a view taken along the line 2—2 of FIG. 1.
Figure 3:
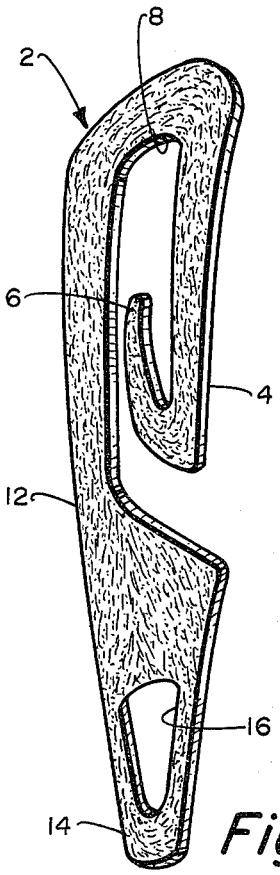
FIG. 3 is a perspective view of the Key Retainer Or The Like of the invention.

Referring to FIG. 2, the curvilinear configuration of retainer 2 is clearly indicated. Upper portion 4 does not lie in the same plane as lower portion 14, but does form what may be considered a spherical plane arc segment conforming to the general contour or exterior configuration of the pelvic area of a human being. Thus, key retainer 2 disposed on the belt loop, belt, or pocket of a human being will not be obtrusive, and will follow the contour of the pelvic area of the wearer, so as to retain keys in as unobstructive manner and inobtrusively as possible.

The key retainer 2 is ideally fabricated of metal, and may have a burnished surface on one or both sides so that key retainer 2 takes on the appearance of a sculptured piece of jewelry. Ideally, the key retainer 2 is of relative thinness so as not to be unduly heavy, yet still perform the intended function of securing keys in a secured, captive relationship as alluded to hereinbefore.

While the key retainer of the invention has been described, with regard to specific materials of construction and configuration, those of ordinary skill in the art will at one recognize various changes and modifications all of which are intended to be covered by the appended claims.

Thus, there has been described a Key Retainer Or The Like of a unique curvilinear configuration in elevational view which permits carrying keys in releasably captive relationship without the need of having bulging pockets or of disrupting the smooth flowing lines of modern fashions.

I claim:

1. A Key Retainer Or The Like comprising the combination: of a one-piece, elongate body member having a first upper portion defining a hook-like configuration with an integrally oriented, upwardly directed terminus adapted for releasable and captive retention thereof with wearing apparel and the like and; a second lower portion having an enclosed aperture for receiving a key ring or the like therein for captive relationship therewith, said body portion in cross-section having a single, smooth, continuous and uninterrupted curvilinear configuration formed along about a single arc segment.

2. The key retainer in accordance with claim 1 wherein said first and second portions lie in different vertical planes.

3. The key retainer in accordance with claim 2 wherein said body member has an open spherical arc-like segment configuration adapted to follow the pelvic contour of the human body.

4. The key retainer in accordance with claim 3 wherein said first portion has a deep depending portion for anchoring on the belt loop of trousers or the like.

5. The key retainer in accordance with claim 4 wherein the material of construction of said key retainer is metal.

6. The key retainer in accordance with claim 5 wherein the surfaces of said key retainer are burnished.

7. The key retainer in accordance with claim 6 wherein said second portion extends laterally beyond the edge of said first portion.

* * * * *